United States Patent [19]

Narita et al.

[11] 4,416,691

[45] Nov. 22, 1983

[54] METHOD FOR CONVERTER BLOW CONTROL

[75] Inventors: Kiichi Narita, Kobe; Akitsu Tomita, Takatsuki; Nozomu Katagiri, Kobe; Kazuyuki Seki, Kobe; Tetuo Sato, Kobe; Minoru Kitamura, Nishinomiya; Shozo Kawasaki, Kobe; Yasuo Kanazuka, Hyogo, all of Japan

[73] Assignee: Kobe Steel, Ltd., Kobe, Japan

[21] Appl. No.: 362,030

[22] Filed: Mar. 25, 1982

Related U.S. Application Data

[63] Continuation of Ser. No. 165,713, Jul. 3, 1980, abandoned, which is a continuation of Ser. No. 934,492, Aug. 16, 1978, abandoned.

[51] Int. Cl.[3] ..... C21C 5/32

[52] U.S. Cl. ..... 75/60

[58] Field of Search ..... 75/60

[56] References Cited

U.S. PATENT DOCUMENTS

| | | | |
|---|---|---|---|
| 3,561,743 | 2/1971 | Schroeder | 75/60 |
| 3,607,230 | 9/1971 | Wintrell | 75/60 |
| 3,669,645 | 6/1972 | Oishi | 75/60 |

*Primary Examiner*—Peter D. Rosenberg

*Attorney, Agent, or Firm*—Oblon, Fisher, Spivak, McClelland & Maier

[57] ABSTRACT

A method for converter blow end-point control which comprises carrying out waste gas analyses on a continuous or intermittent basis in a final stage of the blow and, based on decarburization rate data (waste gas information) obtained from said waste gas analysis, determining the end-point of the blow where the carbon content of the bath equals a target carbon content. The method is characterized by the use of the decarburization rate equation:

$$-\tau = F(c,b) - F\left[f^{-1}\left(-\frac{dc}{dt}, b\right), b\right]$$

which is a differential equation taking account of the delay time ($\tau$) of said waste gas information which is a period of time from the time-point of occurrence of a decarburization reaction in the converter till the time when it is detected as said decarburization rate data, and an equation:

$$b' = g(b)$$

which is a functional equation for increasing the predictability of carbon content of the bath at the end-point of the blow.

10 Claims, 10 Drawing Figures

NUMERALS ON CURVES DENOTE CARBON CONTENT OF BATH:
EACH CURVE REPRESENTS THE EQUATION:

$$\wp = \frac{1-\exp(bx)}{1-\exp(bx)-\exp(-ab\tau)}, \quad (x = c - c_0)$$

METHOD FOR CONVERTER BLOW CONTROL

This is a continuation of application Ser. No. 165,173 filed July 3, 1980 and now abandoned which in turn is a continuation of application Ser. No. 934,492, filed Aug. 16, 1978 now abandoned.

BACKGROUND OF THE INVENTION

1. Field of the Art

This invention relates to a method for dynamic control of the end-point of the converter blow.

2. Description of the Prior Art

In converter processes, control for increasing the predictability of carbon content and bath temperature in the final stage of blow to thereby obtain slags with improved chemical compositions plays an important role and has so far been the subject of much study. For example, it has been proposed to estimate the carbon content of the bath solely based on the rate of carburization near the end-point of the blow and, thereby, control the end-point carbon content. This procedure, however, is not only liable to significant errors due, for example, to changes in amount of the slag formed on the bath surface, and the consequent large variation of accuracy, but also has the disadvantage that it cannot be used for temperature control or to detect the iron oxide content of the slag. Recently the sublance method has been widely and successfully utilized wherein the carbon content and temperature of the bath are directly measured by means of sublances for end-point control purposes. However, this method is not only disadvantageous in that measuring errors due to the uneven distribution of chemical components and temperature in the bath must be solved with some ingenuity but has the drawback that the iron oxide content of the slag cannot be determined. There has also been reported a control system wherein waste gas information is constantly read and updated and the parameters of a decarburization rate model expression are determined using the up-to-date information. Notwithstanding the complicated computations required, it is said that the method is inadequate in predictability. Moreover, the following specific procedures have recently been proposed for blow control based on a combination of carbon content measured by sublance ($C_{SL}$) with waste gas information. A first of these procedures is one using $C_{SL}$ as an integral constant ("Tetsu-to-Hagane" 62, 4, p. 114).

$$C_E = C_{SL} - k \int_{t_{SL}}^{t_E} \left( \frac{dc}{dt} \right) dt.$$

Where $C_E$: The carbon content of the bath at endpoint of the blow $C_{SL}$: The carbon content of the bath at the time-point of sublance measurement $t_E$: time of blow end point $t_{SL}$: the time of sublance measurement K: A coefficient for conversion of the amount (kg) of carbon to the concentration (%) of carbon However, as will be readily understood from the above equation, this control method using an integral value of decarburization rate is not practically useful, because $\sigma(C_E) \geqq \delta(C_{SL})$ and, hence, the error in the sublance measurement is controlling over the accuracy of carbon content at the end point of the blow [the uneven distribution of chemical constituents in the bath and the error inherent in the rapid carbon analysis (Carbon content detector), taken together, result in a fairly large error in measured $C_{SL}$ value].

A second control method, which is reported in Tetsu-to-Hagane 63, 9, p. 21, is such that control is carried out by means of an arbitrary parameter in the equation for obtaining dc/dt from $C_{SL}'$ and $\phi_{SL}$ (Oxygen efficiency for decarburization at the time of sublance measurement) (In the reported case, as to the equation $dc/dt = \alpha + \beta \exp(-\gamma c)$, $\beta$ is determined from $C_{SL}$ and $\phi_{SL}$). However, because this method disregards $\tau$. Carbon content in the bath is estimated only inaccurately. Moreover, when use is made of a parameter such as that used in the reported case, the indefinite physical meaning of the parameter fails to provide a clear picture of its relationship with other factors in converter blow [T control (control of the bath temperature at the end point of the blow) and detection of the iron oxide content of the slag] which is possible in the case of this invention. Thus, attempts to correlate the sublance information with the waste gas information have so far failed to meet with success.

SUMMARY OF THE INVENTION

In regard to the quality control of converter steelmaking, an increasingly higher accuracy has been demanded and the development is awaited of a control method which would provide an improved predictability of carbon content and bath temperature at the end point of the blow. Furthermore, where converters are not provided with sublance means as well as in situations where the costs of the measuring probes are important considerations, it is necessary to develop a method for obtaining and utilizing information from waste gas analyses alone.

This invention fulfils this need and, at the same time, provides a neat solution to the above-mentioned technical problems involved in the end-point blow control of converters.

It is, thus, an object of this invention to provide a method for converter blow control by which the carbon content of the bath at the end point of the blow can be controlled far more accurately than by any of the prior art methods, that is to say a new method which provides an accurate assessment of the condition of each heat and an accurate prediction of blow end-point based on the result of such assessment.

It is another object of this invention to provide a control method which, in addition to the above-mentioned advantage, provides an improved accuracy of bath temperature control and further permits a quantitation of the iron oxide content of the slag.

To accomplish the above-mentioned objects, this invention relates, in one aspect, to a method for converter blow end-point control comprising carrying out waste gas analyses either continuously or at timed intervals in a final stage of the blow and determining the end-point of the blow when the carbon content of the bath coincides with a target carbon content, characterized in that said control is effected using a decarburization rate equation:

$$-\tau = F(C,b) - F\left[ f^{-1}\left( -\frac{dC}{dt}, b \right), b \right] \quad (1)$$

which is a differential equation taking account of the delay time of waste gas information from the time of occurence of the decarburization reaction in the converter till the time of said information being detected as decarburization rate data and a functional expression:

$$b' = g(b) \quad (2)$$

which is a functional equation for improving the predictability of the carbon content of the bath at the end point of the blow.

In the above equations (1) and (2), $\tau$ is the delay time (in minutes) of waste gas information;

dC/dt is the precarburization rate (% per min.);

b is the decarburization rate index (1/%) determined for each heat;

b' is the decarburization rate index (1/%) near the end point of the blow;

C is the carbon content (%) of the bath;

F is the function obtained by the integration of a fundamental decarburization rate formula $$-\frac{dC}{dt} = f(C,b);$$

$f^{-1}$ is a transformation of the fundamental decarburization model formula $$-\frac{dC}{dt} = f(C,b),$$

in which C is a dependent variable; and g(b) is a function for improving the predictability of the carbon content of the bath at the end point of the blow.

In a second aspect of this invention, the above-mentioned equation (1) is at least one member selected from the class consisting of the following equations:

$$-ab\tau = \ln\{\exp(bx) - 1\} - \ln\frac{\varphi}{1-\varphi} \quad (3)$$

$$-ab\tau = \ln bx - \ln\varphi \quad (4)$$

$$-ab\tau = bx - \frac{1}{bx} - \left(\sqrt{\frac{\varphi}{1-\varphi}} - \sqrt{\frac{1-\varphi}{\varphi}}\right) \quad (5)$$

In the above equations (3) to (5), x is C-Co, where Co means the minimum carbon content (%) for steel-making reactions;

a is a constant which is defined by $12.FO_2/(11.2\times 10\ w)$, where $FO_2$ is oxygen flow rate ($Nm^3$/min.) and W is the weight (tons) of the molten steel in the final stage of the blow; and $\phi$ is the oxygen efficiency for decarburization as defined by $$\frac{1}{a}\cdot\frac{dc}{dt}.$$

In a third aspect of this invention, the equation (2) mentioned in connection with the first aspect there of is:

$$b' = \alpha b + \beta \quad (6)$$

where $\alpha$ is a coefficient of b, and $\beta$ is a constant.

A fourth aspect of this invention is such that, in determining the decarburization rate index b in the decarburization rate equation (1) which takes account the said delay time $\tau$ of waste gas information, said decarburization rate index b is directly determined for each heat from the decarburization rate data from waste gas analysis in a final stage of the blow and the carbon content of the bath as measured by means of sublance at that time.

A fifth aspect of this invention is such that, in determining the decarburization rate index b in said decarburization rate equation (1) which takes account of the delay time $\tau$ of waste gas information, said decarburization rate index b is determined for each heat by means of the $$-(t - t_o) = F\left[f^{-1}\left(\left(-\frac{dC}{dt}\right)_t, b\right), b\right] - F\left[f^{-1}\left(\left(-\frac{dC}{dt}\right)_{to}, b\right), b\right] \quad (7)$$

which is a equation which accounts for the change with time of the decarburization rate from the waste gas analysis made in the final stage of the blow. In the above equation (7), $t_o$ is the time-point of detecting the decarburization rate value in the final stage of the blow; t is an arbitrary time-point between $t_o$ and the end point of the blow; and $$\left(-\frac{dc}{dt}\right)_{to} \text{ and } \left(-\frac{dc}{dt}\right)_t$$

are the decarburization rates at $t=t_o$ and t, respectively.

A sixth aspect of this invention is such that, in the above fifth aspect, the equation (7) is at least one equation selected from the group consisting of the equations:

$$-ab(t - t_o) = P - P_o \text{ where } P = \ln\frac{\varphi}{1-\varphi} \quad (8)$$

$$-ab(t - t_o) = P - P_o \text{ where } P = \ln\varphi \quad (9)$$

$$ab(t - t_o) = P - P_o \text{ where } P = \sqrt{\frac{\varphi}{1-\varphi}} - \sqrt{\frac{1-\varphi}{\varphi}} \quad (10)$$

Referring to the equations (8) through (10), Po is the value of P at $t=t_o$.

A seventh aspect of this invention is such that, in the fourth aspect described above, the equation (2) is:

$$b' = \alpha x_1 b + \alpha_2 C_{SL} + \alpha_3 T_{SL} + \beta_1 \quad (11)$$

where $C_{SL}$ is the carbon content of the bath at the time of sublance measurement;

$T_{SL}$ is the bath temperature at the time of sublance measurement;

$\alpha i (i=1,2,3)$ are the coefficients of b, $C_{SL}$ and $T_{SL}$, respectively;

$\beta_1$ is a constant.

An eighth aspect of this invention is such that, in the first aspect described hereinbefore, wherein said decarburization rate index b is substituted in said equation (2) to determine the decarburization rate index b' near the end point of the blow, said decarburization rate equation ① in which b is substituted with said b′ is used as such, the decarburization rate data from said waste gas analysis are read in and the carbon content of the bath is determined from each decarburization rate data thus read in and the time-point at which the carbon data thus obtained equals a target carbon content is used as the end point of the blow. A nineth aspect of this invention is such that, in said first aspect thereof, the decarburization rate index b determined as aforesaid is substituted in said equation ② to determine the decarburization rate index b′ near the end point of the blow, said equation ① in which b has been substituted with this b′ is employed as such, a target carbon content is previously substituted in said decarburization rate equation ① to calculate a target decarburization rate value, the decarburization rate data from said waste gas analysis is read in and the time-point at which the decarburization rate data thus read in equals said target decarburization rate value is used as the end point of the blow.

BRIEF DESCRIPTION OF THE DRAWINGS

FIG. 2-1 is a graphic representation showing the relation of b, the decarburization rate index at the time-point of sublance measurement, with b, the decarburization rate index at the end point of blow, according to exponential model.

FIG. 2—2 is a graphic representation showing the relation of b, the decarburization rate index at the end point of the blow, with b, the calculated decarburization rate index at the end point of the blow, according to exponential model.

DETAILED DESCRIPTION OF THE PREFERRED EMBODIMENTS

Figure 1:
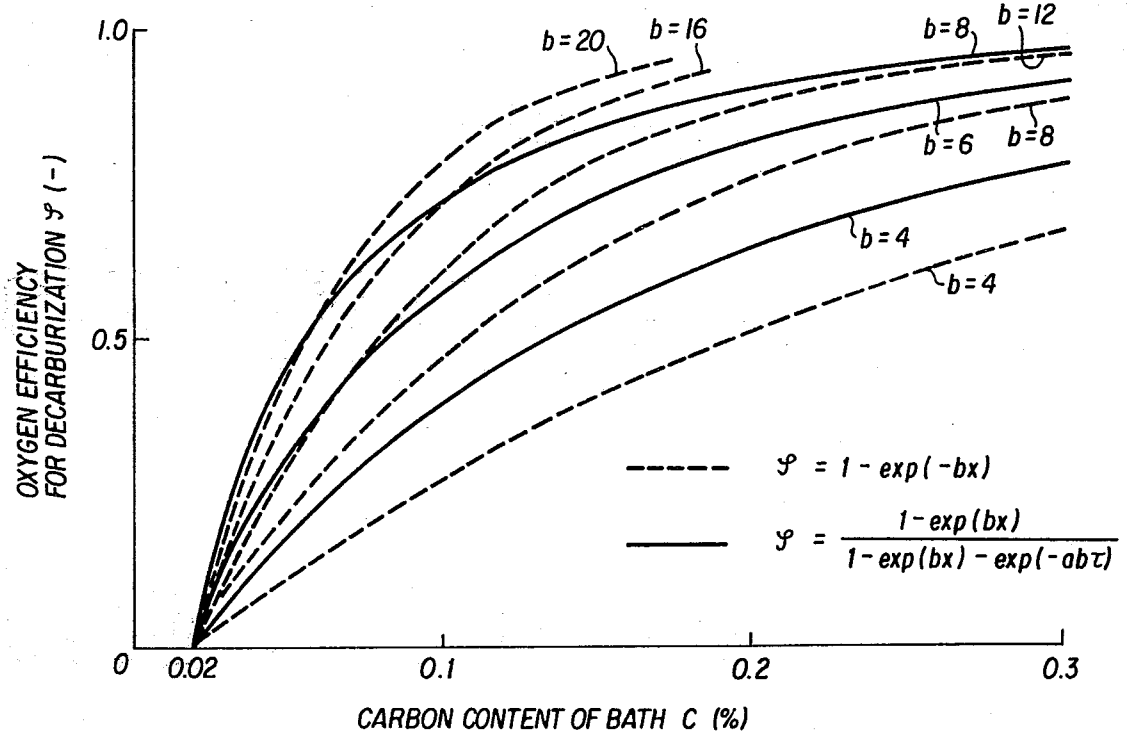
FIG. 1 is a diagram showing the relation of the carbon content of the bath with oxygen efficiency for decarburization, the solid line representing the relation of $\varphi$ with C actually observed in the converter which is due to the delay time $\tau$ of waste gas information.

This invention relates to a method for controlling the end point of the blow in converter operation which comprises carrying out waste gas analyses either continuously or intermittently in a final stage of the blow and, based on the decarburization rate data obtained from results of said waste gas analyses, accurately determining the end point of the blow where the carbon content of the bath reaches the target carbon content. More particularly, this invention relates to a method for controlling the converter blow which comprises employing a fundamental decarburization rate equation (1):

$$-\frac{dc}{dt} = f(c,b) \tag{1}$$

where $-dc/dt$: decarburization rate (%/min.)

f(c,b): the function of the fundamental decarburization model, c: carbon content of the bath (%), b: a decarburization rate index determined for each heat (1/%)

rearranging the same equation mathematically to a deffrential decarburization rate equation (2), which takes account of the delay time $\tau$ of waste gas information which is a period of time from the time-point of occurence of a decarburization reaction in the converter till the time when it is detected as said decarburization rate data, $$-\tau = F(c,b) - F\left[f^{-1}\left(-\frac{dc}{dt}, b\right), b\right] \tag{2}$$

where $\tau$: the delay time of waste gas information (min.)

F: the function obtained by the integration of fundamental decarburization model equation (1)

$f^{-1}$: the expression obtained by transforming C in fundamental decarburization model formula (1) into a dependent variable, and a function (3) which is designed to improve the predictability of said carbon content of the bath for achieving an accurate control of the carbon content of the bath at the end point of the blow.

$$b' = g(b) \tag{3}$$

where b′: the decarburization rate index near the end point of the blow (1/%)

g(b): the function for improving the predictability of the carbon content of the bath at the end point of the blow.

It should be understood that the term "converter" as used herein means any of the LD converter, bottom-blown converter (Q-BOP), argon oxygen decarburization (AOD) vessel and vacuum oxygen decarburization (VOD) vessel.

It should also be understood that the aforementioned fundamental decarburization rate equation (1) means at least one formula selected from the group consisting of the following equations:

$$\text{Exponential model: } \varphi = -\frac{1}{a}\frac{dc}{dt} = 1 - \exp(-bz) \tag{4}$$

$$\text{Linear model: } \varphi = -\frac{1}{a}\frac{dc}{dt} = bx \tag{5}$$

$$\textit{IRSID}\text{ model: } \varphi = -\frac{1}{a}\frac{dc}{dt} = (bz)^2/\{1 + (bz)^2\} \tag{6}$$

where $\varphi$: the oxygen efficiency for decarburization as given by $-\frac{1}{a}\ \frac{dc}{dt}$;

a: the constant given by 12 $FO_2/(11.2\times 10\ w)$, where $FO_2$ is oxygen flow rate ($Nm^3$/min.) and W is weight of molten steel (tons) in final stage of the blow;

x: C-Co, where Co is the minimum carbon content (%) for steel-making reactions.

Now, a general transformation of the above fundamental decarburization model formula (1) gives the aforementioned decarburization rate equation (2) as follows.

Integrating formula (1) yields:

$$-\int dt=\int dc/f(c,b) \tag{7}$$

Therefore, from equation (7), $$-t=F(c,b)+I \tag{8}$$

where $F(c,b)=\int dc/t(c,b)$; I is an integral constant.

Assuming that $C=C_1$ and C at the time-points of $t_1$ and t, respectively, I is eliminated to obtain:

$$-(t-t_1)=F(c,b)-F(c,b) \tag{9}$$

Now, to positively take account of said delay time $\tau$ of waste gas information, it is postulated:

$$t=t_1+\tau \tag{10}$$

Then, $-dc/dt$ as found at t=t is the decarburization rate obtaining in the converter at the time-point of $t_1$ and, thereof, $$-dc/dt=f(c_1,b) \tag{11}$$

Equation (11) is rearranged to:

$$C_1=f^{-1}\left(-\frac{dc}{dt},b\right) \tag{12}$$

Substituting equations (10) and (12) into equation (9) gives the aforementioned decarburization rate equation (2):

$$-\tau = F(c,b) - F\left[f^{-1}\left(-\frac{dc}{dt},b\right),b\right] \tag{2}$$

This represents the actual relation of C with $-dc/dt$ which obtains in a commercial converter where $\tau$ cannot be neglected.

Therefore, in accordance with this invention, b in said equation (2) is determined at a suitable time-point in a final stage of the blow and the equation (2) is used in combination with the aforementioned equation (3) to control the carbon content of the bath at the end point of the blow with improved accuracy.

Since the fundamental decarburization model formula (1) means any of the three different decarburization models given by said equations (4) to (6), it actually represents at least one member selected from the group consisting of the following equations:

$$-ab\tau = \ln\{\exp(bz)-1\} - \ln\frac{\varphi}{1-\varphi} \tag{13}$$

-continued $$-ab\tau = \ln bx - \ln\varphi \tag{14}$$

$$-ab\tau = bx - \frac{1}{bx} - \left(\sqrt{\frac{\varphi}{1-\varphi}} - \sqrt{\frac{1-\varphi}{\varphi}}\right) \tag{15}$$

To control the carbon content of the bath at the end point of the blow, the decarburization rate index b appearing in said equations (2) must be determined. This index may be determined by the following two alternative procedures.

[I] From the decarburization rate data obtained from the waste gas analysis performed in a final stage of the blow and the carbon content of the bath as found by sublance measurement, the decarburization rate index b is directly calculated for each heat by means of the aforementioned equation (2).

[II] Alternatively, the decarburization rate index b is determined for each heat by means of a time-change equation (16) which is applicable to the decarburization rate found by the waste gas analysis performed in a final stage of the blow:

$$-(t-t_o) = F\left[f^{-1}\left(\left(-\frac{dc}{dt}\right)_t,b\right),b\right] - F\left[f^{-1}\left(\left(-\frac{dc}{dt}\right)_{to},b\right),b\right] \tag{16}$$

where to: the time-point at which the decarburization rate is determined in a final stage of the blow;

t: an arbitrary time-point between to and the end point of the blow;

$$\left(-\frac{dc}{dt}\right)_{to},\left(-\frac{dc}{dt}\right)_t;$$

the decarburization rates at the time-points of t=to and t, respectively.

The equation (16) can be derived in the same manner as equation (2). Thus,

Assuming, again, that $C=C_1$ when $t=t_1$ and C=C when t=t, the fundamental decarburization model formula (1) will be:

$$\left(-\frac{dc}{dt}\right)_{t=t+\tau} = f(c,b) \tag{17}$$

$$\left(-\frac{dc}{dt}\right)_{t=t1+\tau} = f(c_1,b) \tag{18}$$

The equations (17) and (18) are respectively rearranged to:

$$C = f^{-1}\left[\left(-\frac{dc}{dt}\right)_{t=t+\tau},b\right] \tag{19}$$

$$C_1 = f^{-1}\left[\left(-\frac{dc}{dt}\right)_{t=t1+\tau},b\right] \tag{20}$$

Substituting (19) and (20) into equation (8) respectively gives:

$$-(t+\tau) = F\left[f^{-1}\left\{\left(-\frac{dc}{dt}\right)_{t+\tau}, b\right\}, b\right] \quad (21)$$

$$-(t_1+\tau) = F\left[f^{-1}\left\{\left(-\frac{dc}{dt}\right)_{t1+\tau}, b\right\}, b\right] \quad (22)$$

The integral constant I can be eliminated by subtracting (22) and (21). Since the time-points on the left-hand side and the right-hand side are relevant to $t+\tau$ and $t_1+\tau$ for both equations (21) and (22), rewriting them as t and to gives the aforementioned time-change equation (16) for decarburization rate ($-dc/dt$).

-continued $$-ab(t-to) = P - Po, \text{ where } P = \sqrt{\frac{\varphi}{1-\varphi}} - \sqrt{\frac{r\varphi}{\varphi}} \quad (25)$$

In the above equations (23) to (25), Po represents the value of P at the time-point of t=to. Thus, equation (16) represents at least one member selected from the group consisting of equations (23), (24) and (25).

The derivations of the various decarburization models given above are summarized in Table 1, where for brevity's sake, the fundamental decarburization model formula $-dc/dt=f(c,b)$ is written as $\varphi=f(x,b)$ (herein $$\varphi = -\frac{1}{a}\frac{dc}{dt}, x = C - Co),$$

that is to say as a relation of x with $\varphi$

TABLE 1

| Designation of model | Fundamental model | Indeterminate integral | Relation of x with $\varphi$ | Change of $\varphi$ with time |
|---|---|---|---|---|
| | | Derivation of Various Decarburization Models | | |
| General model | $\varphi = f(x, b)$<br>$x = f^{-1}(\varphi, b)$ | $F(x, b) = \int dx/f(x, b)$ | $-\tau =$<br>$F(x, b) - F[f^{-1}(\varphi, b), b]$ | $-(t - t_o) =$<br>$F[f^{-1}(\varphi, b), b] - F[f^{-1}(\varphi o, h)]$<br>($\varphi o$ represents value of $\varphi$ where $t = t_o$) |
| Exponential model | $\varphi = 1 - \exp(-bx)$<br>$x = -\frac{1}{b}\ln(1-\varphi)$ | $\frac{1}{ab}\ln\{\exp(bx) - 1\}$ | $-ab\tau = \ln\{\exp(bx) - 1\} - \ln\frac{\varphi}{1-\varphi}$ | $-ab(t - t_o) = P - P_o$<br>$P = \ln\frac{\varphi}{1-\varphi}$ |
| Linear model | $\varphi = bx$<br>$x = \frac{1}{b}\varphi$ | $\frac{1}{ab}\ln x$ | $-ab\tau = \ln(bx) - \ln\varphi$ | $-ab(t - t_o) = P - P_o$<br>$P = \ln\phi$ |
| IRSID model | $\varphi = \frac{(bx)^2}{1+(bx)^2}$<br>$x = \frac{1}{b}\left(\frac{\varphi}{1-\varphi}\right)^{\frac{1}{2}}$ | $\frac{1}{ab}\left(bx - \frac{1}{bx}\right)$ | $-ab\tau = bx - \frac{1}{bx} - \left(\sqrt{\frac{\varphi}{1-\varphi}} - \sqrt{\frac{1-\varphi}{\varphi}}\right)$ | $-ab(t - t_o) = P - P_o$<br>$P = \sqrt{\frac{\varphi}{1-\varphi}} - \sqrt{\frac{1-\varphi}{\varphi}}$ |

$$-(t-t_o) = F\left[f^{-1}\left\{\left(-\frac{dc}{dt}\right)_{t+\tau}, b\right\}, b\right] - F\left[f^{-1}\left\{\left(-\frac{dc}{dt}\right)_{to}, b\right\}, b\right] \quad (16)$$

Therefore, by finding the change of $-dc/dt$ with time through use of this equation (16), the decarburization rate index b in said equation (2) can be determined for the particular heat.

Further, rewriting the above time-change equation (16) for decarburization rate for each of the three different fundamental decarburization models given by equations (4) to (6) hereinbefore yields:

$$-ab(t-to) = P - Po, \text{ where } P = \ln\frac{\varphi}{1-\varphi} \quad (23)$$

$$-ab(t-to) = P - Po, \text{ where } P = \ln\varphi \quad (24)$$

As will be apparent from the foregoing description, the blow control method according to this invention is characterized by the employment of said differential decarburization rate equation (2) which includes and takes account of the delay time $\tau$ of waste gas information and said functional equation (3) which is adapted to improve the predictability of the carbon content of the bath at the end point of the blow. More particularly, the method according to this invention is characterized in that:

(A): the decarburization rate index b is determined from the carbon content of the bath at the time of sublance measurement ($C_{SL}$) and the oxygen efficiency for decarburization at that time ($\varphi$SL) or (B): the decarburization rate index b is determined from the change with time of oxygen efficiency for decarburization $\varphi$.

Now, this invention will be further described in detail. The above aspect (A) will first be described in detail. In accordance with this aspect of the invention, the carbon content of the bath is first measured by means of a sublance at a suitable time-point in a final stage of the blow and, the decarburization rate is determined from a waste gas analysis which is also performed at the same time-point. The aforementioned equation (2) is applied to the data thus obtained to determine the decarburization curve (decarburization rate index b) for the particular heat and this curve is used to determine the end point of the blow. There is no particular limitation on the method for measuring the carbon content of the bath and the method for determining the decarburization rate. That is to say, the invention is characterized in that, in correlating the measured carbon content of the bath with the decarburization rate obtaining at the very time-point, the delay time involved in the waste gas information is properly taken into account and the equation (2) thus derived to include this delay time is used in the form of a differential expression to thereby construct a decarburization curve with ease and accuracy and, hence, permit a very precise control of the end-point carbon content of the bath which has never been feasible by the prior art methods where waste gas information and sublance information are independently utilized, where these data are correlated without consideration of the delay time or where the two data are correlated by an integral formula.

Now, the procedure for determining the decarburization curve will be explained with reference to the curve based on the exponential model, i.e. equation (4), it being to be understood that the same argument applies as well in cases where other model equations (5) and (6), both given hereinbefore, are respectively employed.

It is generally acknowledged that in a final stage of the blow, the following relation holds as aforesaid between the decarburization rate $$\left[-\frac{dc}{dt}\ (\%/\text{min.})\right]$$

and the carbon content [C(%)] of the bath (exponential model).

$$-\frac{dc}{dt} = a[1 - \exp\{-b(C - Co)\}] \quad (4)$$

(4)

Using the oxygen efficiency for decarburization which is given by $$\varphi = -\frac{1}{a}\cdot\frac{dc}{dt},$$

the above relation may also be written as $$\varphi = 1 - \exp\{-b(C - Co)\} \quad (4)'$$

Co in the above formulas is a constant representing the minimum carbon content for steel-making reactions and, for general purposes, may be set at about 0.02%. The symbol b denotes the decarburization rate index for the particular heat, and is a determinant of the decarburization curve. The curves indicated in broken lines in FIG. 1 show the relation of C with $\varphi$ in equation (4) for various values of b. The decarburization reaction would proceed along this curve if the waste gas information involves no delay time. In an actual converter operation, however, the waste gas information involves a delay time ($\tau \doteqdot 0.3$ to 0.5 min.) which varies from one plant to another depending on equipment and operating conditions and, in the practice of this invention, the magnitude of such delay time should be individually determined and properly reffected in the construction of the decarburization curve. Thus, equation (4)' does not hold true as a relation between $\varphi$ and C as measured. This is why the present inventor has derived the aforementioned equation (2) [which corresponds to the equation (13) given hereinbefore for the exponential model] which takes account of the delay time.

Referring, again, to FIG. 1, the curves shown in solid line represent the case in which such a delay time is taken into account, that is to say the decarburization rate curve according to equation (13).

$$\varphi = \frac{1 - \exp(bx)}{1 - \exp(bx) - \exp(-ab\tau)}$$

It will be seen that the curves given in broken and solid lines are markedly different.

Figures 1, 2:
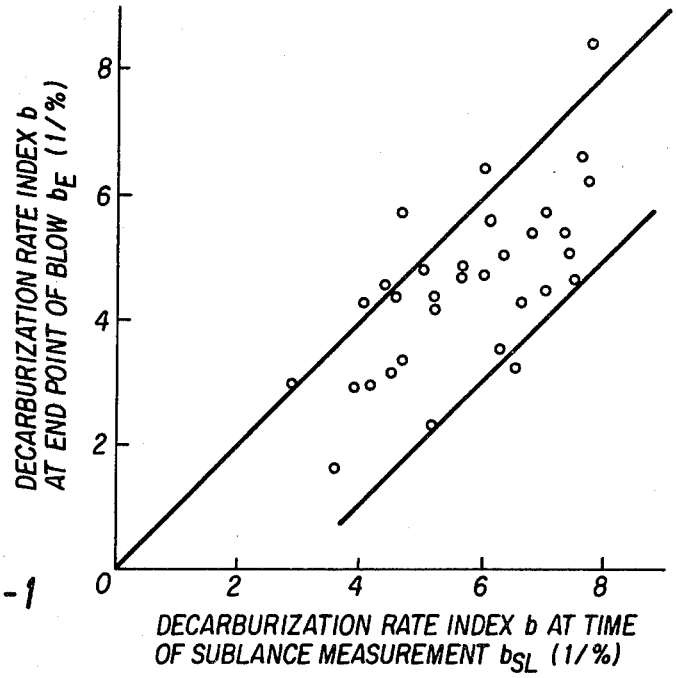
Figure 2:
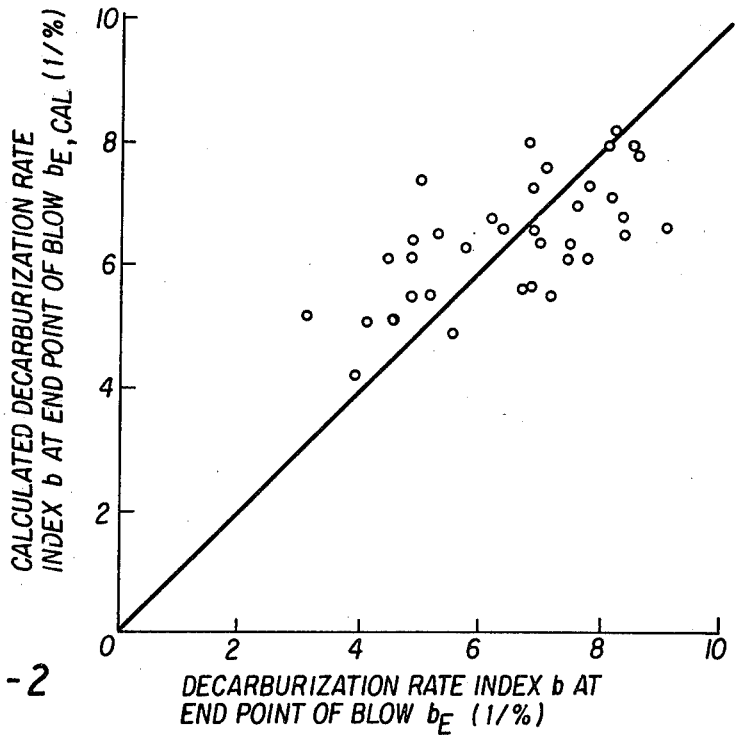

Substituting $C = C_{SL}$, $C_E$ and $\varphi = \varphi_{SL}$, $\varphi_E$ into equation (13) [where $C_{SL}$, $\varphi$SL, $C_E$ and $\varphi$E are the carbon content of the bath and the oxygen efficiency for decarburization, at the time of sublance measurement and at the end point of the blow, respectively] mathematically yields the values of b (designated as $b_{SL}$ and $b_E$) based on the values of C and $\varphi$ at the time of sublance measurement and at the end point of the blow, respectively. The application of the data obtained by actual operations has shown that, as will be apparent from FIG. 2-1, the values are distributed between 2 and 8 while satisfying the relation of $b_{SL} \doteqdot b_E$. This is indicative of the fact that, in a actual converter, the decarburization curve is approximated by equation (13) and this invention has been conceived and developed on the basis of a discovery of the above relationship. However, as is evident from FIG. 2-1, actual converter operations do not strictly follow the relation of $b_E = b_{SL}$. That is to say, the use of $b_{SL}$ as such does not provide a sufficiently accurate control of end-point carbon content. This problem can, however, as is apparent from FIG. 2-2, be overcome by means of an apparent relation between $b_{SL}$ and $b_E$, such as:

$$b' = g(b) \quad (3)$$
$$= g(b_{SL}) = \alpha b_{SL} + \beta (\alpha \text{ is a coefficient for } b_{SL}, \beta \text{ is a constant}) \quad (26)$$

or $$b' = g(b_{SL}, C_{SL}, T_{SL}) \quad (27)$$
$$= \alpha_1 b_{SL} + \alpha_2 C_{SL} + \alpha_3 T_{SL} + \beta_1 \quad (28)$$

($T_{SL}$ is the bath temperature obtained at the time of sublance measurement)

Therefore, the carbon content of the bath at the end point of the blow can be controlled with exceedingly high accuracy by means of equations (2) and (3) or equations (2) and (27).

Figure 3:
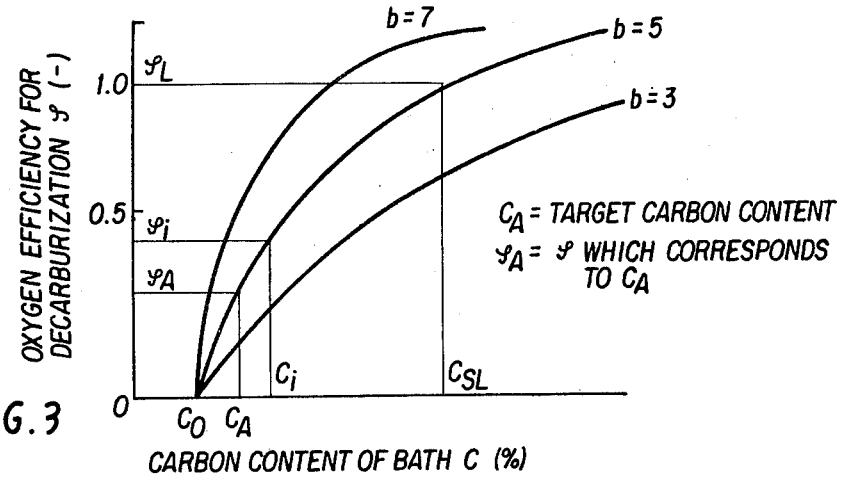
FIG. 3 is a graph showing the relation of both carbon content C with oxygen efficiency $\varphi$ for decarburization.

Once the value of b' has thus been obtained, the carbon content of the bath at the end point of the blow can be accurately controlled by any of various procedures, such as: Procedure I:

The values of $\varphi$ from waste gas analyses are read ($\varphi_i$) and Ci is determined from each $\varphi$i by means of equation (13). The time-point when the Ci thus determined coincides with the target carbon content is regarded as the end point of the blow (FIG. 3). Procedure II:

$\varphi_A$ (FIG. 3) is determined by substituting b' and target carbon content into equation (13) and the time-point at which the $\varphi$ value from waste gas analysis equals $\varphi_A$ is regarded as the end point of the blow.

Which of these alternative procedures to take is at the option of the person who may wish to work this invention.

Table 2 shows the comparison of $C_E$ as estimated from $\varphi_E$ at the end-point of the blow by means of equation (13) with $C_E$ as found in actual converter operations. It is apparent that the method of this invention provides a markedly higher predictability than does any of the prior art method depending solely on sublance information.

TABLE 2

The accuracy of end-point carbon content predictions

| Carbon content of bath at the end point of blow (%) | Accuracy of carbon content prediction | | $\sigma$(%) | |
|---|---|---|---|---|
| | This invention | Prior art* | This invention | Prior art* |
| $C_E \leqq 0.06$ | 95% within ±0.01 | 90 to 95% within ±0.02 | 0.007 | 0.017 |
| $0.06 < C_E \leqq 0.1$ | 95% within ±0.02 | 85 to 90% within 0.02 | 0.012 | 0.018 |
| $0.1 < C_E \leqq 0.2$ | not less than 90% within ±0.02 | 45 to 55% within ±0.02 | 0.016 | 0.030 |

*Prior art method depending solely on sublance information without using waste gas information.

In Table 2, $\sigma$ denotes the standard deviation in the differences between the predicted end-point carbon content and the field operation data. The advantage of the method of this invention is at once apparent and the predictability of this invention is particularly high in the region of low carbon content.

Figure 4:
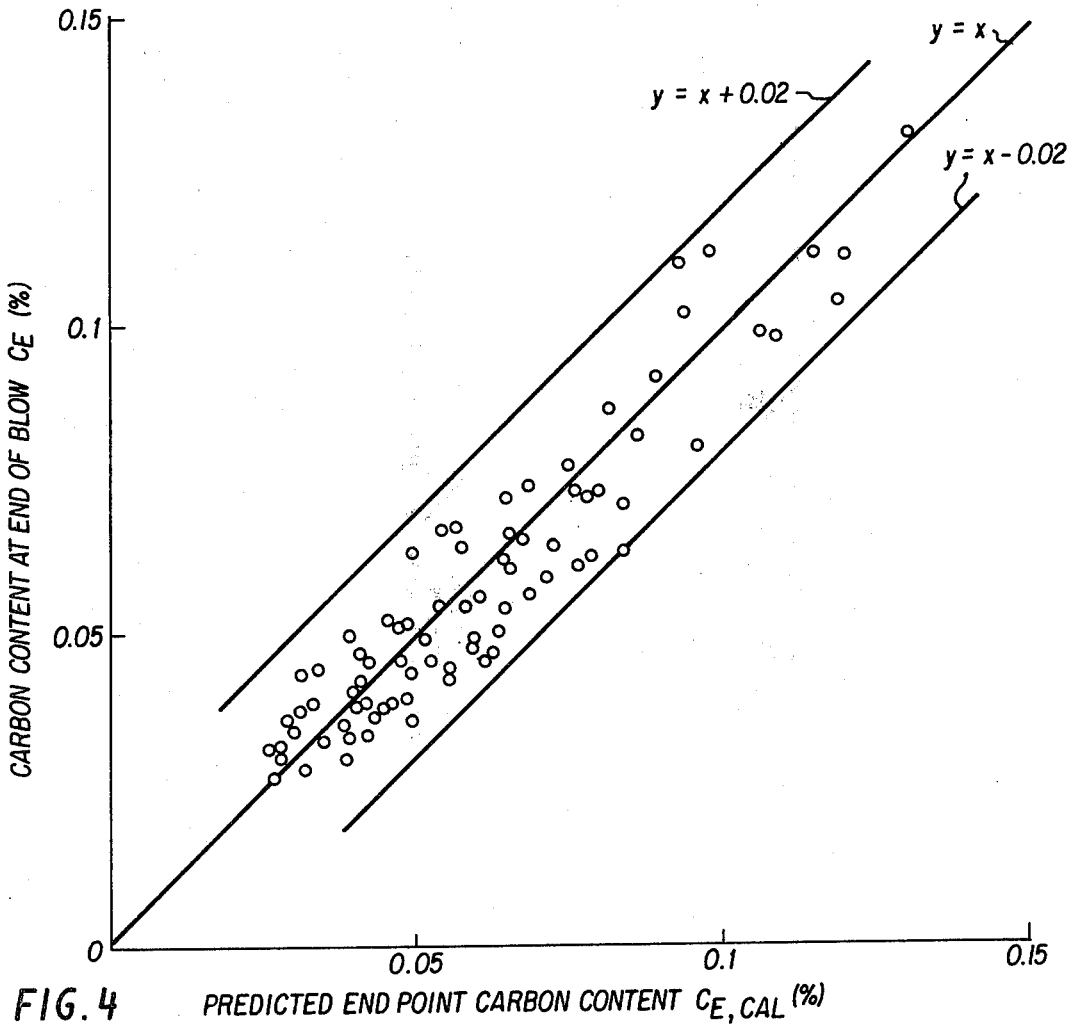
FIG. 4 is a graph showing the relation of the predicted carbon content at the end point of the blow with the observed carbon content at the same time point.

FIG. 4 shows the predicted carbon content at the end point of the blow versus the actual carbon content. It is apparent that there is a good agreement between the two sets of values.

It is thought that the high carbon predictability of this invention can be attributed to the following.

(i) Because the carbon content found by sublance measurement is correlated with the decarburization rate obtaining at the time of such measurement, the variation in decarburization rate from one heat to another is eliminated.

(ii) Because the influence of the delay time involved in waste gas data is properly evaluated in the correlation mentioned above in (i), an end-point control reflecting the characteristics of each heat is made feasible. This also provides a basis for the possibility of improving temperature control and detection of the iron oxide content of the slag which are to be described hereinafter.

(iii) As will be explained below, the influence of an error in the measurement of $C_{SL}$ on the carbon content at the end point of the blow decreases exponentially with a drop in carbon content. Moreover, since the influences of errors in CO and $CO_2$ analyses at the time of sublance measurement and at the end point of the blow work in the same direction, these errors are not significant factors.

Figure 5:
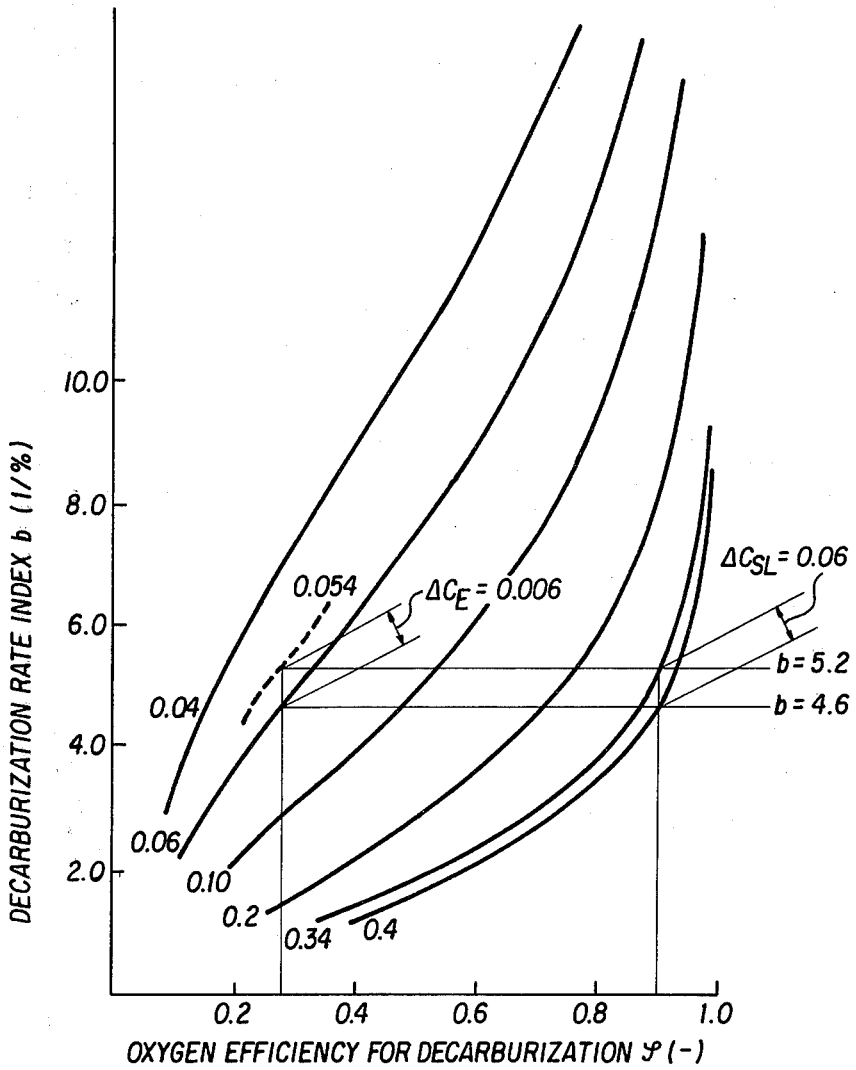
FIG. 5 is a graph showing the relation of oxygen efficiency for decarburization $\varphi$ with decarburization rate index b.

FIG. 5 is a graphic representation showing the relation of oxygen efficiency for decarburization with decarburization rate index b as given by equation (2) at varying C of the bath. According to the graph, if the true $C_{SL}=0.34\%$ but the measured $C_{SL}-0.4\%$ (or vice versa) when $\varphi=0.9$, $\Delta C_{SL}$ is 0.4–0.34=0.06% and the carbon content error (%) at a later stage when $\varphi$ has decreased with the progress of the blow to $\varphi=0.28$ is 0.06–0.054=0.006. Thus, the error in sublance measurement at $\varphi=0.9$ (0.06%) is reduced to 0.006 (%) at this later time-point or only about 10% of the previous value. It is, therefore, clear that the influence of errors in the measurement of $C_{SL}$ can be effectively eliminated by the method of this invention. As is apparent from the above, the control method according to this invention provides a considerably high % carbon predictability.

Figure 6:
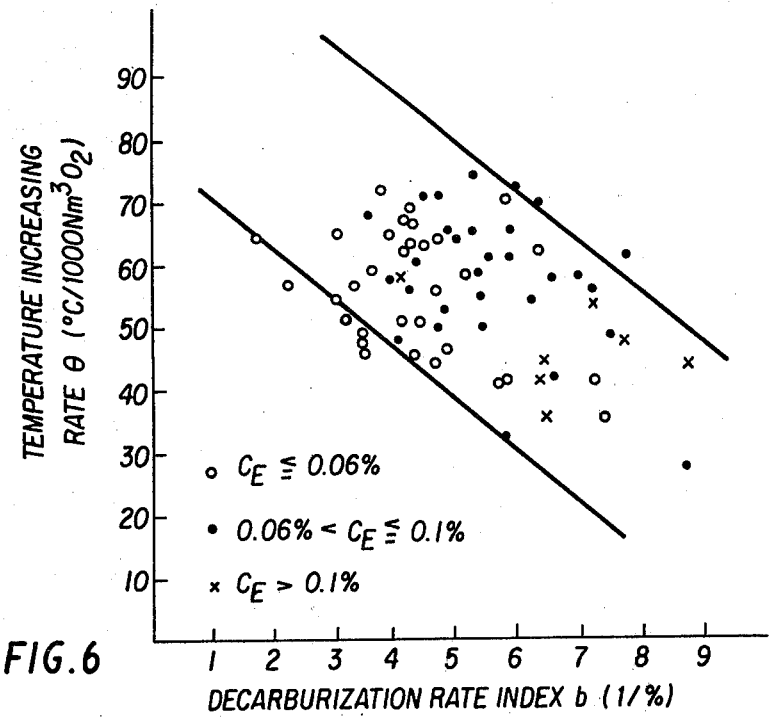
FIG. 6 is a graph showing the relation of decarburization rate index b with the rate of temperature increase.

It has also been found that the method of this invention provides to an improved predictability as to the bath temperature at the end point of the blow. Thus, while FIG. 6 is a graphic representation showing the relationship of b as calculated by equation (13) at the time-point of sublance measurement with the measured rate of temperature increase (0). It will be apparent from FIG. 6 that the rate of temperature increase decreases as the magnitude of b increases. This is presumably because the higher the value of b, the higher the oxygen efficiency for decarburization and, hence, the combustion reaction ratio of carbon becomes greater than the combustion reaction ratio of Fe. In any event, because the accuracy of estimation of the rate of temperature increase is significantly improved by using the index $b_{SL}$, the accuracy of estimation of the bath temperature which has heretofore been estimated by the computation formula:

$$T=T_{SL}+\theta\Delta GO_2$$

($\Delta GO_2$: the amount of oxygen blown after sublance measurement) can be further improved.

By way of illustration, the field data obtained by the present applicant have shown that the accuracy of prediction of the rate of temperature increase drops from 10.1° to 8.0° C./1000 $Nm^3O_2$ in the standard deviation thereof.

The feasibility of delineating the iron oxide content of the slag, which is another advantage of this invention, will now be described. In converter blow, the iron oxide content of the slag must not be less than a certain level in order to accelerate the removal of P and S but if the iron oxide content is too high, the iron yield is decreased and the life of the converter refractory is shortened. It is, therefore, another consideration in steel-making to control the iron oxide content within an appropriate range. However, there has been available no effective procedure for detecting the T.Fe level (the proportion of iron present in the form of iron oxide in the slag) in the couse of the blow.

Figure 7:
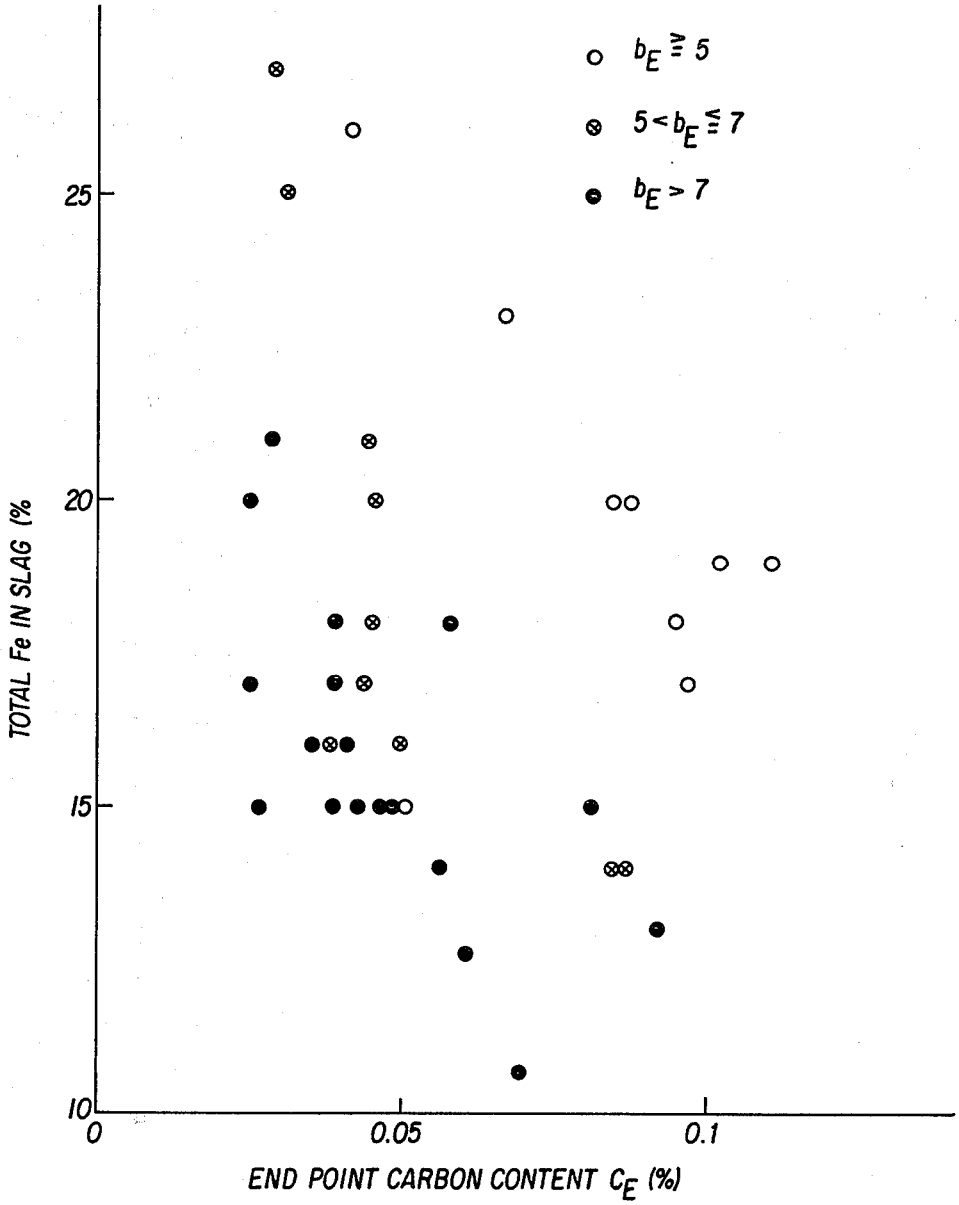
FIG. 7 is a graph showing the relation of end-point carbon content $C_E$ with the total Fe content of the slag.

FIG. 7 is a graphic representation showing the plots of T.Fe% against $C_E$ in the case of this invention, where the carbon content $C_E$(%) at the end point of the blow and the T.Fe values (%) of the slag as grouped by $b_E$ are represented on the horizontal and vertical axes, respectively.

It will be seen from this graph that the higher the value of b, the smaller the value of T.Fe and this phenomenon seems to arise from the fact that as b is increased, the oxygen efficiency for decarburization becomes greater and, hence, the combustion reaction ratio of Fe is decreased. As a result, the order of T.Fe (%) for a given heat can be ascertained by knowing the value of b and, accordingly, numerous advantages such as an improvement in predictability for that charge, a stabilization of dephosphorization and desulfurization processes and a stabilization of iron yield can be obtained.

While the foregoing description has been directed to the exponential model, substantially the same control accuracy can be, and has been, obtained in the case of the other models as well. Typical such results are shown in Table 3. In the table, the values in brackets represent the $C_E$ predictabilities of the various models when $\tau=O$ and the relation of $b'=\alpha b_{SL}+\beta$ is not employed, for comparison purposes.

The comparison clearly demonstrates the advantage of this invention which takes account of the delay time $\tau$ of waste gas information and employs the functional equation $b'=g(b_{SL})$ for improving the predictability of the carbon content of the bath at the end point of the blow.

TABLE 3

| Decarburization model | Decarburization model equation | The $C_E$ predictability of the model considering $\tau$ and b' ($\tau$= 0.4 min, b' = $\alpha b_{SL}+\beta$) $C_E$ (%): 0.06 or less $\overline{\Delta C_E}$ % × 100 | $\sigma$ % × 100 | $C_E$ (%): 0.06-0.1 $\overline{\Delta C_E}$ % × 100 | $\sigma$ % × 100 | $C_E$ (%): 0.1-0.2 $\overline{\Delta C_E}$ % × 100 | $\sigma$ % × 100 |
|---|---|---|---|---|---|---|---|
| Exponential | Equation (13) | −0.004 | 0.70 | 0.032 | 1.20 | 0.091 | 1.60 |
| | [Equation (4)] | [−1.5] | [1.47] | [−4.8] | [3.84] | [−5.1] | [3.31] |
| Linear | Equation (14) | 0.047 | 0.66 | 0.11 | 1.31 | 0.17 | 1.58 |
| | [Equation (5)] | [−2.9] | [2.30] | [−8.1] | [4.32] | [−11.8] | [6.49] |
| IRSID | Equation (15) | −0.016 | 0.66 | −0.2 | 1.29 | −0.037 | 1.29 |
| | [Equation (6)] | [−3.2] | [1.52] | [−6.5] | [4.15] | [−5.0] | [3.60] |

$\overline{\Delta C_E}$ : average of $\Delta C_E$ = observed end-point carbon content (%) minus calculated end-point carbon content (%)

(note)

The figures in brackets denote the $C_E$ predictabilities of various models when $\tau$ = and the relation b' = $\alpha b_{SL}+\beta$ is not employed.

(note)

The figures in brackets denote the $C_E$ predictabilities of various models when $\tau=0$ and the relation $b'=\alpha b_{SL}+\beta$ is not employed.

The control method involving the use of sublance information in combination with waste gas information has been described. The Procedure (B) mentioned hereinbefore will now be described in detail.

The control method of this invention, which is pertinent to Procedure (B), is characterized in that, in grasping the condition of the particular heat during the blow solely from the waste gas information obtained by continuous or intermittent measurements, the condition of the bath during the blow is grasped on the basis of said equation (16).

Where sublance is available for controlling the carbon content of the bath, Procedure (A) described hereinbefore provides control with exceedingly high accuracy but in the case of converters not equipped with sublance (e.g. small-sized converters) as well as where the measuring probes are important economic considerations, it is necessary to obtain and utilize sufficiently effective information from waste gas data alone. This invention has been accomplished in view of the above fact, too.

Attainment of effective information from waste gas data alone is possible, for example by deriving an expression relevant to the change with time of the oxygen efficiency for decarburization $\varphi$.

It is for this purpose that the time-change equations for the various decarburization models in Table 1 [corresponding to the aforementioned equations (23) to (25)] have been derived.

As in the case of Procedure (A), the above operation will be explained with reference to the exponential model.

a further transformation of said equation (23) gives:

$$\varphi=\frac{1}{1+\frac{1-\varphi_o}{\varphi_o}\exp\{(ab(t-t_o)\}} \tag{29}$$

This equation is used as a correlation formula corresponding to the chart pattern of a decarburization rate detector.

Figure 8:
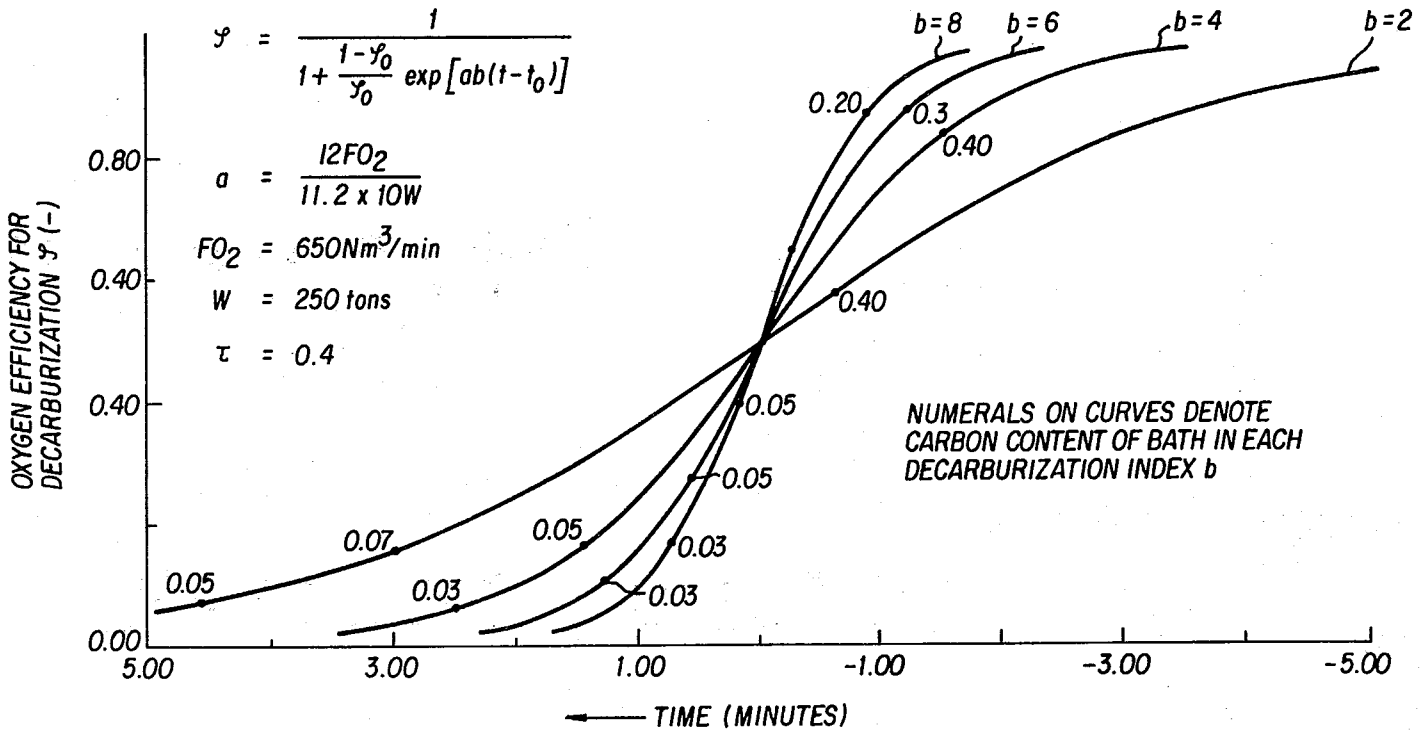
FIG. 8 is a graph showing the relation of time with oxygen efficiency for decarburization $\phi$.

FIG. 8 is a graphic representation of equation (29) when oxygen flow rate $FO_2$ is 650 $Nm^3$/min. and the weight of molten steel W in the final stage of the blow is 250 tones, where the curves correspond to b=2,4, 6, and 8, respectively. This graph bears a close resemblance with the observed pattern.

Figure 9:
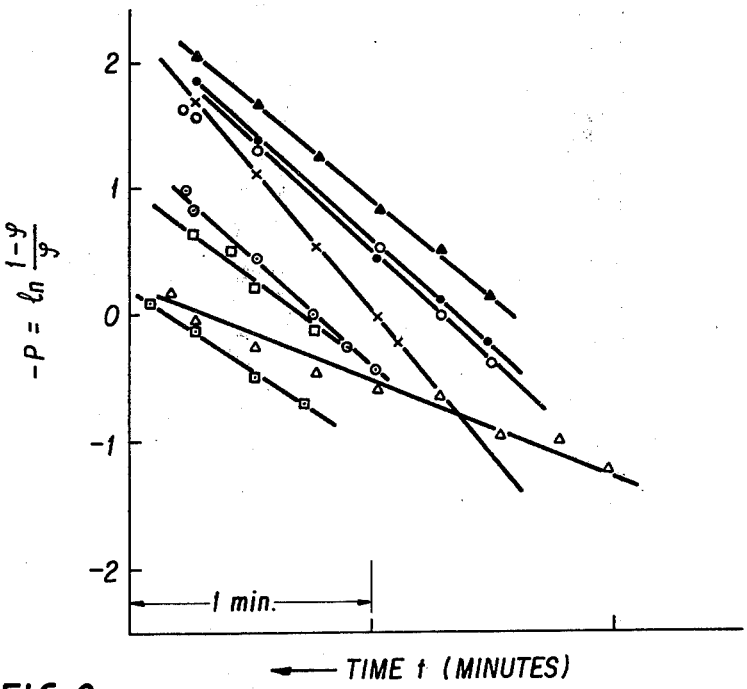
FIG. 9 is a graph showing the relation of time with $$-P = \ln \frac{1-\varphi}{\varphi}.$$

FIG. 9 is an example of the plots of ln $1-\varphi/\varphi$ against t as obtained by reading the decarburization rate charts. There is a relationship of good lineality which suggest the validity of the relation given by equation (23).

The procedure of calculating b by means of equation (23) will now be explained. Let it now be assumed that $\varphi=\varphi_1$ and $\varphi=\varphi_2$ when $t=t_1$ and $t=t_2$, respectively. Then, from equation (23), $$-ab(t_1-t_2)=P_1-P_2 \tag{30}$$

Since $t_1-t_2$ represents the time over which $\phi$ drops from $\phi_1$ to $\phi_2$, it is now rewritten as $\Delta t$. Thus, $$b=\frac{-1}{a}\cdot\frac{\Delta P}{\Delta t}$$

It is, thus, possible to calculate the decarburization rate index b for the particular heat without using the sublance information (carbon content of the bath as measured with the sublance.)

The desired control of end-point carbon content by means of the value of b thus obtained can be performed with accuracy by using the following equation (26)' in the same manner as described hereinbefore with reference to equation (26).

$$b'=g(b) \tag{3}$$
$$=ab+\beta \tag{26)'}$$

In controlling the end-point carbon content using the b' obtained as above, a couple of procedures similar to the procedures I and II described hereinbefore may be mentioned by way of example.

Field converter control trials with the use of equation (23) have given the results set forth in Table 4. The results are set forth in the table together with comparative data by other control methods.

TABLE 4

| Control method | Comparison of the accuracy of end-point carbon prediction: $\sigma$ (%) × 100 at $C_E$ (%) = 0.06 or less | $\sigma$ (%) × 100 at $C_E$ (%) = 0.06–0.1 | $\sigma$ (%) × 100 at $C_E$ (%) = 0.1–0.2 |
|---|---|---|---|
| sublance | 1.7 | 1.8 | 3.0 |
| sublance plus waste gas analysis | 0.7 | 1.2 | 1.6 |
| Waste gas analysis | 0.8 | 1.5 | 1.9 |

It will be apparent form the above description that this invention provides an improve carbon content predictability solely on the basis of waste gas information. It has also been found that this invention has an additional advantage that it enables the iron oxide content of the slag to be grasped as well. Thus, because the higher the oxygen efficiency for decarburization, that is to say the greater the value of b, the lower the iron oxide content of the slag, and the value of b can now be obtained by means of equation (31), the iron oxide content of the slag can now be accurately determened. Of course, the same reasoning is applicable to the other models as well.

As has already been mentioned hereinbefore, this invention provides an estimation of the decarburization curve without being significantly influenced by errors in the intermediate carbon measurement, because the carbon content at the time of sublance measurement is correlated with the decarburization rate at the time-point while the delay time of waste gas information is taken into account. As a result, the invention permits an easy and accurate control of the end-point carbon content and bath temperature, for instance, thus making for a still improved stability of converter operations. This invention further makes it possible to obtain a high-precision prediction of the carbon content, iron oxide content of the slag and other variables at the end point of the converter blow, thus contributing again to an improved stability of converter operations.

What is claimed as new and intended to be covered by Letters Patent is:

1. A method for controlling the end point of the converter blow in an oxygen converter for the manufacture of low-carbon steel comprising carry out waste gas analyses in the final stage of the blow, to determine the rate at which carbon is being removed from the steel and thereby the decarburization rate of the blow; measuring the carbon content of the metal in said converter; solving a model differential decarburization rate equation, which takes into account the time delay between the occurrence of a decarburization reaction in the converter and its detection in the waste gas analyses, for the endpoint of the converter blow, wherein said model differential decarburization rate equation (1) is $$-\tau = F(c,b) - F\left(f^{-1}\left(-\frac{dc}{dt}, b\right), b\right) \quad (1)$$

wherein $\tau$ is the time delay (minutes), $-dc/dt$ is the decarburization rate (% min.), b is the decarburization rate index (1/%) as determined for each heat of molten metal, c is the carbon content (%) of the molten metal, F is a function obtained by the integration of a fundamental decarburization model formula, $$-dc/dt = f(c,b)$$

$f^{-1}$ is an expression derived from said fundamental decarburization model formula, $$-dc/dt = f(c,b)$$

where c is a dependent variable, and t is time and $$b' = g(b) \quad (2)$$

wherein b' is the decarburization rate index (1/%) near the endpoint of the blow, and g(b) is a function for improving the predictability of the carbon content of the molten metal at the endpoint of the blow;

wherein in determining the decarburization rate index, b', near the endpoint of the blow by substituting the decarburization rate index, b, into equation (2), control of the carbon content of the molten metal is achieved by substituting b' for b in equation (1), substituting the decarburization rate obtained by the waste analyses into equation (1) and the time point at which the so calculated carbon content coincides with a preselected target carbon content is the end point of the blow; and stopping said blow when the calculated endpoint is reached.

2. A method for controlling the end point of the converter blow in an oxygen converter for the manufacture of low-carbon steel comprising carry out waste gas analyses in the final stage of the blow, to determine the rate at which carbon is being removed from the steel and thereby the decarburization rate of the blow; measuring the carbon content of the metal in said converter; solving a model differential decarburization rate equation, which takes into account the time delay between the occurrence of a decarburization reaction in the converter and its detection in the waste gas analyses, for the endpoint of the converter blow, wherein said model differential decarburization rate equation (1) is $$-\tau = F(c,b) - F\left(f^{-1}\left(-\frac{dc}{dt}, b\right), b\right) \quad (1)$$

wherein $\tau$ is the time delay (minutes), $-dc/dt$ is the decarburization rate (% min.), b is the decarburization rate index (1/%) as determined for each heat of molten metal, c is the carbon content (%) of the molten metal, F is a function obtained by the integration of a fundamental decarburization model formula, $$-dc/dt = f(c,b)$$

$f^{-1}$ is an expression derived from said fundamental decarburization model formula:

$$-dc/dt = f(c,b)$$

where c is a dependent variable, and t is time and $$b' = g(b) \quad (2)$$

wherein b′ is the decarburization rate index (1/%) near the endpoint of the blow, and g(b) is a function for improving the predictability of the carbon content of the molten metal at the endpoint of the blow;

wherein in determining the decarburization rate index, b′, near the endpoint of the blow by substituting the decarburization rate index, b, into equation (2), control of the carbon content of the molten metal is achieved by substituting b′ for b in equation (1), substituting a preselected target carbon content into equation (1) and the time point at which the so calculated decarburization rate coincides with the decarburization rate obtained by waste gas analyses is the endpoint of the blow; and stopping said blow when the calculated endpoint is reached.

3. The method for controlling the endpoint of the converter blow, according to claims 1 or 2, wherein said waste gas analyses are made continuously.

4. The method for controlling the endpoint of the converter blow, according to claim 1 or 2, wherein said waste analyses are made intermittently.

5. The method for controlling the endpoint of the converter blow, according to claims 1 or 2, wherein said model differential decarburization rate equation (1) is selected from the group consisting of the following equations:

$$-ab\tau = \ln(\exp(bx) - 1) - \ln\frac{\psi}{1-\psi} \quad (3)$$

$$-ab\tau = \ln(bx) - \ln(\psi) \quad (4)$$

and $$-ab\tau = bx - \frac{1}{bx} - \frac{\psi}{1-\psi} - \frac{1-\psi}{\psi} \quad (5)$$

wherein in equations (3), (4) and (5)

x is $c-c_o$ where $c_o$ is the minimum carbon content (%) for steelmaking reactions;

a is a constant given by $12FO_2/112W$ where $FO_2$ is the oxygen flow rate ($Nm^3$/min) and W is the weight of molten steel (tons) in the final stage of the blow; and $\psi$ is oxygen efficiency for decarburization $$\left(-\frac{1}{a}\cdot\frac{dc}{dt}\right).$$

6. The method for controlling the endpoint of the converter blow, according to claims 1 or 2, wherein said equation (2) is:

$$b'' = \alpha + \beta \quad (6)$$

wherein $\alpha$ is a coefficient of b, and $\beta$ is a constant.

7. The method for controlling the endpoint of the converter blow, according to claims 1 or 2, wherein in determining the decarburization rate index, b, in said model differential decarburization rate equation (1), which takes into account the time delay, said decarburization rate index, b, is directly determined for each heat by means of said equation (1) from the decarburization rate obtained by the waste gas analyses in the final stage of the blow and the measured carbon content of the metal in the converter as found by a sublance measurement of the carbon content.

8. The method for controlling the endpoint of the converter blow, according to claims 1 or 2, wherein in determining the decarburization rate index, b, in said model differential decarburization rate equation (1), which takes into account the time delay, $\tau$, said decarburization rate index, b, is determined for each heat by means of a time-change equation (7):

$$-(t - t_o) = F\left(f^{-1}\left(\left(-\frac{dc}{dt}\right)_t, b\right), b\right) - F\left(f^{-1}\left(\left(\frac{dc}{dt}\right)_{t_o}, b\right), b\right) \quad (7)$$

wherein $t_o$ is the time point at which the decarburization rate is detected in the final stage of the blow;

t is an arbitrary time point between $t_o$ and the end of the blow; and $$\left(-\frac{dc}{dt}\right)_{t_o} \text{ and } \left(-\frac{dc}{dt}\right)_t$$

are the decarburization rates obtained at the time points $t=t_o$ and $t=t$, respectively.

9. The method for controlling the endpoint of the converter blow, according to claim 8, wherein said time change equation (7) is selected from the group consisting of the following equations:

$$-ab(t - to) = P - Po \text{ where } P = \ln\left(\frac{\psi}{1-\psi}\right) \quad (8)$$

$$-ab(t - to) = P - Po \text{ where } P = \ln\psi \quad (9)$$

$$-ab(t - to) = P - Po \text{ where } P = \frac{\psi}{1-\psi} - \frac{1-\psi}{\psi} \quad (10)$$

wherein in equations (8), (9) and (10), P and Po are the values of P at $t=t$ and $t=t_o$, respectively.

10. The method for controlling the endpoint of the converter blow, according to claim 7, wherein said equation (2) is:

$$b' = \alpha_1 b + \alpha_2 C_{SL} + \alpha_3 T_{SL} + \beta_1 \quad (11)$$

wherein $C_{SL}$ is the carbon content of the molten metal at the time of the sublance measurement;

$T_{SL}$ is the temperature of the molten metal at the time of the sublance measurement;

$\alpha_i$(i=1, 2, 3) are coefficients for b, $C_{SL}$ and $T_{SL}$, respectively, and $\beta_1$ is a constant.

* * * * *

UNITED STATES PATENT AND TRADEMARK OFFICE

CERTIFICATE OF CORRECTION

PATENT NO. : 4416691

DATED : NOVEMBER 22, 1983

INVENTOR(S) : KIICHI NARITA, AKITSU TOMITA, NOZOMU KATAGIRI, KAZUYUKI SEKI, TETUO SATO

It is certified that error appears in the above-identified patent and that said Letters Patent is hereby corrected as shown below:

| Col. | Line | |
|---|---|---|
| 3 | 14 | Change "precarburization" to --decarburization--. |
| 3 | 57 | Before "1/a," please insert -- - -- (a minus sign). |
| 4 | 55 | Please delete "a" and insert -- $\alpha$ --. |
| 5 | 32 | After "of," please insert --the--. |
| 6 | equation (4) equation (6) | In both occasions, delete "z" and insert --x--. |
| 9 | 12 | Please change "and" to --from--. |
| 10 | equation 25 | Change "r" to --1--. |
| 10 | Table 1 | For first entry in the right hand column, please change "h" to --b--. |
| 11 | 71 | Delete "(4)". |
| 12 | 9 | After "(13)", please insert --[The expression--. |
| 12 | 13 | After the equation set forth, please insert --in Fig. 1 is a transformation of equation (13)].-- |
| 13 | 2 | Before "0.02" in the third entry in the column labelled "Prior Art," please insert --±--. |
| 15 | 31 | After "$\gamma$=", please insert --0--. |

UNITED STATES PATENT AND TRADEMARK OFFICE

CERTIFICATE OF CORRECTION

PATENT NO. : 4416691

DATED : NOVEMBER 22, 1983

INVENTOR(S) : KIICHI NARITA, AKITSU TOMITA, NOZOMU KATAGIRI, KAZUYUKI SEKI, TETUO SATO

It is certified that error appears in the above-identified patent and that said Letters Patent is hereby corrected as shown below:

| Col. | Line | |
|---|---|---|
| 15 | 33-36 | Please delete in their entirety. |
| 16 | equation 29 | Please delete "(" before "ab". |
| 16 | 13 | Change "tones" to --tons--. |
| 16 | 49 | Insert --(31)-- at the extreme right hand end of the line. |
| 17 | 35 | Change "the" (second occurrence) to --that--. |
| 19 | 60 | In equation (6), please insert --b-- after "a". |
| 20 | Claim 9 | In equations (8), (9) and (10), change "to" to --$t_0$--, each occurrence. |

Signed and Sealed this

*Nineteenth* Day of *March 1985*

[SEAL]

*Attest:*

DONALD J. QUIGG

*Attesting Officer* *Acting Commissioner of Patents and Trademarks*